United States Patent [19]

Hall et al.

[11] Patent Number: 4,519,286

[45] Date of Patent: May 28, 1985

[54] METHOD AND APPARATUS FOR ANIMATED HARMONIZATION

[75] Inventors: Robert J. Hall, Chatsworth; George R. Hall, Sherman Oaks; Jack C. Cookerly, Saugus, all of Calif.

[73] Assignee: Norlin Industries, Inc., Deerfield, Ill.

[21] Appl. No.: 391,764

[22] Filed: Jun. 24, 1982

Related U.S. Application Data

[63] Continuation-in-part of Ser. No. 274,606, Jun. 17, 1981.

[51] Int. Cl.[3] ..... G10F 1/00

[52] U.S. Cl. ..... 84/1.03; 84/1.24; 84/DIG. 22

[58] Field of Search ..... 84/1.03, 1.01, 1.24, 84/1.17, DIG. 22, DIG. 12

[56] References Cited

U.S. PATENT DOCUMENTS

| | | | |
|---|---|---|---|
| 4,311,076 | 1/1982 | Rucktenwald et al. | 84/1.03 |
| 4,368,658 | 1/1983 | Deutsch et al. | 84/1.03 |
| 4,379,420 | 4/1983 | Deutsch | 84/1.03 |

*Primary Examiner*—Forester W. Isen

*Attorney, Agent, or Firm*—Nilsson, Robbins, Dalgarn, Berliner, Carson & Wurst

[57] ABSTRACT

A method and associated apparatus for sounding music played by a performer according to a preselected style. Accompaniment notes having a harmonious tonal relationship to preselected melody and chord information are arranged into a plurality of groups. Appropriate accompaniment notes are selected from the groups in accordance with musically derived sequences and sounded for preselected periods of time so that the melody and chord chosen by the performer are sounded in accordance with a derived playing style.

5 Claims, 10 Drawing Figures

METHOD AND APPARATUS FOR ANIMATED HARMONIZATION

CROSS-REFERENCE TO RELATED APPLICATION

This is a continuation-in-part of pending U.S. patent application No. 274,606 filed June 17, 1981 for "Method and Apparatus for Improved Automatic Harmonization".

FIELD OF THE INVENTION

The present invention pertains to electronic musical instrumentation. In particular, the invention pertains to methods and apparatus for rendering the music selected by a performer in accordance with a preselected playing style.

BACKGROUND AND SUMMARY OF THE INVENTION

Various systems exist in the prior art for deriving accompaniment notes that enhance a melody in accordance with the selected harmony. Pending U.S. patent application Ser. No. 274,606 discloses a substantial improvement over prior art enhancement techniques that were, in general, hampered in the selection of accompaniment notes by limitation to a preselected musical compass below the melody note.

The art existing prior to the method and apparatus disclosed in the referenced patent application was thus unable to utilize advantageous non-chordal or non-scale tones when such tones were not explicitly sounded by the musician. Such a drawback becomes particularly critical when a musician of limited playing ability and/or dexterity seeks to sustain an accompanying chord with only a minimum number of tones. The invention described in the referenced application incorporates some significant aspects of musicianship into the automated instrument art by providing a system in which accompaniment notes are derived on the basis of the harmonic relationship between the melody and the selected chord. Briefly, the invention disclosed in that application achieves enhanced harmonization through the use of a plurality of listings of accompaniment notes in tables suitable for data processing. Data storage requirements are minimized through the utilization of a system of accompaniment note identification based upon musical transposition.

The aforementioned system and other harmony supplementation methods and apparatus of the prior art, while greatly enhancing the quality of the performed work, often betray their mechanical or electromechanical origins resulting in somewhat of a tradeoff between the improved harmonization achieved and a loss of realism due to the exactness with which the music is performed. This can sometimes result in a mechanical and unappealing musical texture.

The above-stated deficiency of prior art harmonization systems arises from the failure of such systems to recognize and incorporate the qualities of musicianship which lend character and realism to the performance of a skilled musician. For example, automatic harmonization systems conventionally sound the entire set of selected accompaniment notes at a single time. This generates an overall musical effect which differs from that one would expect from a skilled performer and/or orchestra. Skilled musicians add "style" to their performances by sounding accompaniment notes in various formats including sequences rather than simultaneous soundings of accompaniment notes. Further, a group of musicians, however skilled, will rarely, if ever, achieve the type of synchronization which commonly characterizes orchestrations performed by means of an electronic organ.

Attempts have been made in the prior art to enable an instrument, such as an electronic organ, to emulate techniques performed by a skilled musician to add realism and musicianship to the performance. The adaptation of various orchestrations by an electronic organ has been enhanced by prior art systems which in fact attempt to incorporate characteristics associated with the style of play of a selected instrument. Thus, the addition of the feature known as "automatic reiteration" to an organ incorporating banjo instrumentation overcomes, to some degree, the difficulty inherent in attempting to make an organ voiced to sound like a banjo (and played as an organ) make a convincing replica of a banjo being played. In automatic reiteration, all of the sounded notes, both melody and accompaniment, are repeatedly keyed.

Another technique which enables the performer to create a more realistic effect is the technique known in the organ industry as "delay vibrato". This technique is particularly appropriate in the playing of a violin where the performer holds a sustained note for a period of time, thereafter rocking his fingers to cause a vibrato effect. Electronic organs employing this effect commonly wait until the player sustains a note for a period of time before adding the electronic vibrato effect.

The foregoing systems which add realism to a performance by electronic organ, deal with each of the notes struck by the performer whether melody or fill note in a uniform manner. While the addition of such features aids a few of the common playing techniques, such treatment is simplistic in light of the broad range of musicianship which cannot thereby be adequately performed.

Very desirable musical effects result from the modification of the harmonizing notes in a manner independent of the melody note or any modification of the melody note. Three popular playing styles which rely upon the sequential soundings of harmonious accompaniment notes during the hold down period of the melody are known as "country piano", "strum" and "accordion" (or "tremolo").

The country piano style has evolved from the attempts of pianists to emulate the sounds of the fiddle and the mandolin, instruments whose strings are tuned in consecutive fifths. One technique according to country piano style is typified by the popular performer Floyd Cramer. This style is characterized by the addition to the melody of a single accompaniment note, as an appoggiatura, to a second accompaniment note chromatically adjacent to or separated by one or more chromatic tones. The melody note is not affected by the change of accompaniment notes. The appogiatura note is typically a short note while the sustained accompaniment note is held for the remainder of the melody. To avoid a monotonous musical texture, the skilled musician is selective in his use of this effect applying the technique in a sparing manner for maximum musical impact.

A strum effect may have one of a number of recognized forms in which different accompaniment notes are struck non-simultaneously and held. In the instance of a guitar-type strum, the accompaniment notes are generally sounded sequentially, either up or down in pitch, for preselected time periods before an additional accompaniment note is sounded.

A type of strum may be advantageously applied to orchestrations involving a number of instruments. In the playing of a musical piece, different performers, although seeking to synchronize with each other, will inevitably sound their instruments at differing points in time. Thus, an automatic harmonization technique wherein a plurality of accompaniment notes are sounded at slightly different points in time and held add a rich and realistic texture to the resulting music.

Tremolo emulates a technique often performed by accordion players. Such technique is accomplished by alternating two harmonious accompaniment notes as the melody note is sounded. This effect, which is done to break the monotony of sustained melody notes, often occurs as other accompaniment notes are held with the melody note.

Thus, highly advantageous musical effects may be realized by the implementation of automatic techniques and apparatus for effecting the sequential sounding of a plurality of harmonious accompaniment notes as a melody note is sounded. The present invention overcomes the disadvantages of the prior art and achieves the aforesaid advantageous result by providing, in a first aspect, a method for embellishing a melody selected by a performer in conjunction with a chord according to a predetermined musical style. The method, accomplished by the instrument itself, includes the steps of deriving a plurality of accompaniment notes, each of the notes being based upon the harmonic relationship of the melody to the chord and sounding the accompaniment notes in a preselected format to effect the predetermined musical style.

The invention provides, in an additional aspect, a method for embellishing a melody selected by a performer in conjunction with a chord, according to a predetermined musical style. The method, accomplished by the instrument itself, includes the step of deriving a plurality of accompaniment notes, each of such notes being based upon the harmonic relationship of the melody to the chord. More particularly, plural groups of accompaniment notes are provided, each of such accompaniment notes being associated with a chord and melody. The method further proceeds by the step of selecting at least one accompaniment note from each of the groups according to the melody and chord selected by the performer. The final step comprises sounding the accompaniment notes in a preselected format.

In a further aspect, the invention provides a method for deriving a plurality of signals in response to a melody note signal and a chord signal, the plurality of signals representing a corresponding plurality of accompaniment notes harmonically related to the melody note and to the chord and temporally related to effect a predetermined musical style. The method includes the step of storing a plurality of groups of listings of accompaniment notes. Each of the listings of a group corresponds to a chord type and provides at least one accompaniment note harmonically related to each melody note of the chromatic scale with respect to the chord type. The groups are arranged so that the listings of accompaniment notes for a particular musical chord type are related from group to group in accordance with the predetermined musical style. At least one preselected constant time value is provided and associated with at least one of the groups of listings. The root and type of the chord are then derived from the chord signal. The melody note is derived from the melody note signal. Listings are selected from the plurality of groups in accordance with the type of the chord. At least one accompaniment note is then located in each of the listings according to the chord root and melody note. Thereafter, a plurality of accompaniment note signals is sequentially generated, each of such signals being responsive to at least one accompaniment note of a selected listing, at least one of the signals having a duration corresponding to the constant value associated with the group from which it is derived.

In yet another aspect, there is provided apparatus for embellishing a melody selected by a performer in conjunction with a chord according to a predetermined musical style. Such apparatus includes means for deriving a plurality of accompaniment notes. There is also provided means for sounding the accompaniment notes in a preselected format.

These and other objects, advantages and features of the present invention will appear for purposes of illustration, but not of limitation, in connection with accompanying drawings wherein like numbers refer to like parts throughout and wherein:

DETAILED DESCRIPTION OF THE INVENTION

Figure 1:
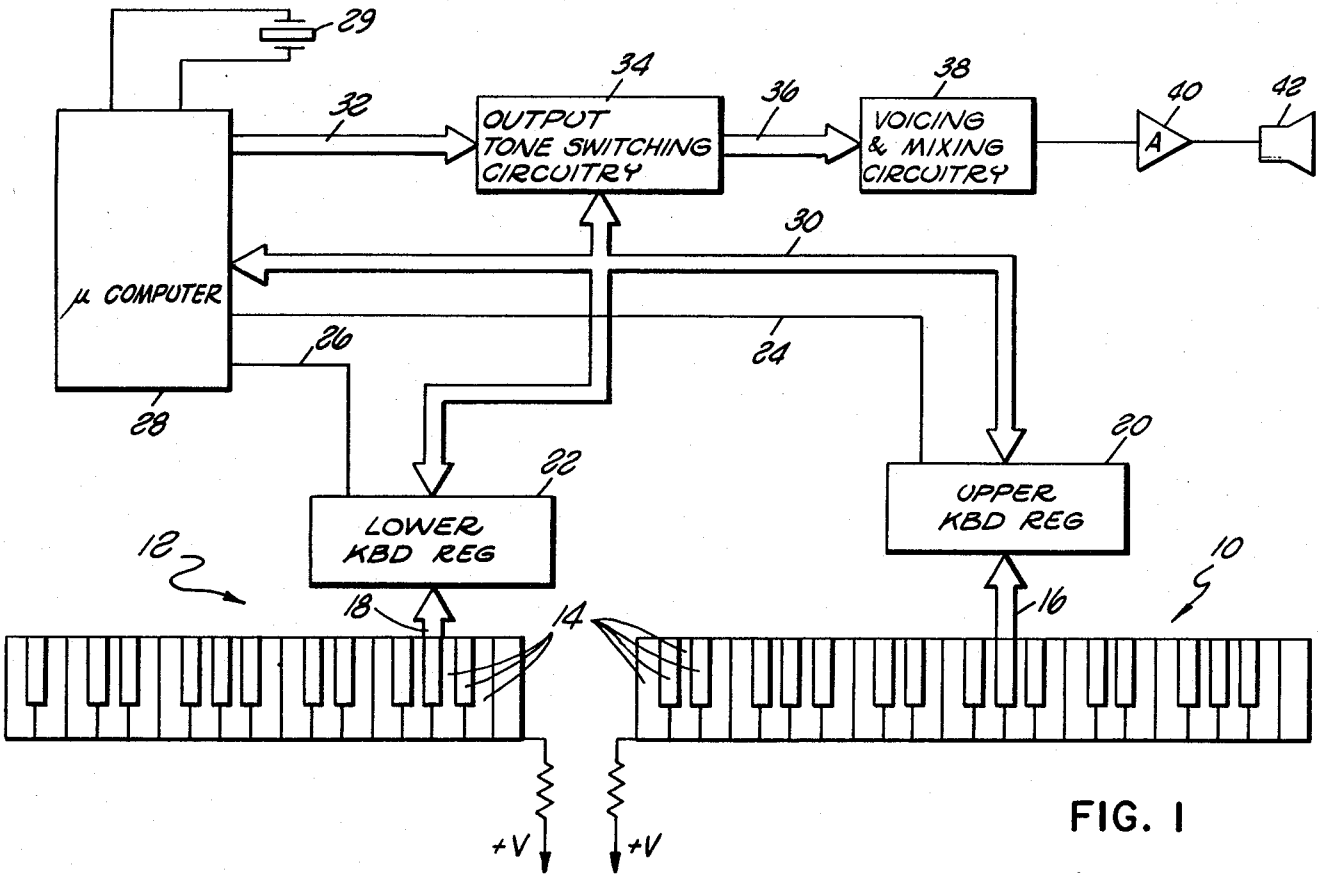
FIG. 1 is a system schematic view of the present invention.
Figure 2A:
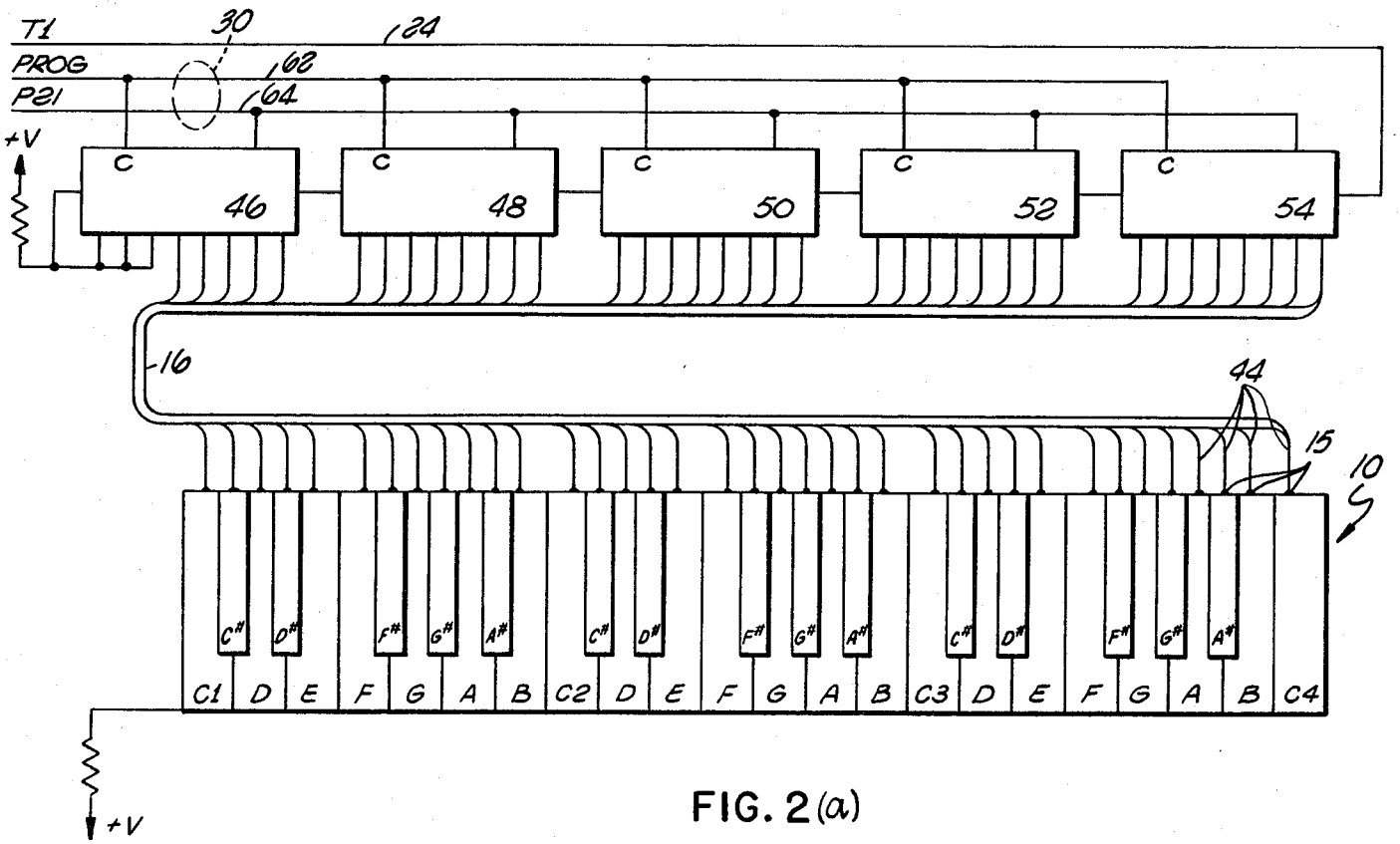
FIGS. 2*a* and 2*b* present schematic diagrams of the upper or melody and the lower or harmony keyboard input circuitry, respectively, of the present invention.
Figure 2B:
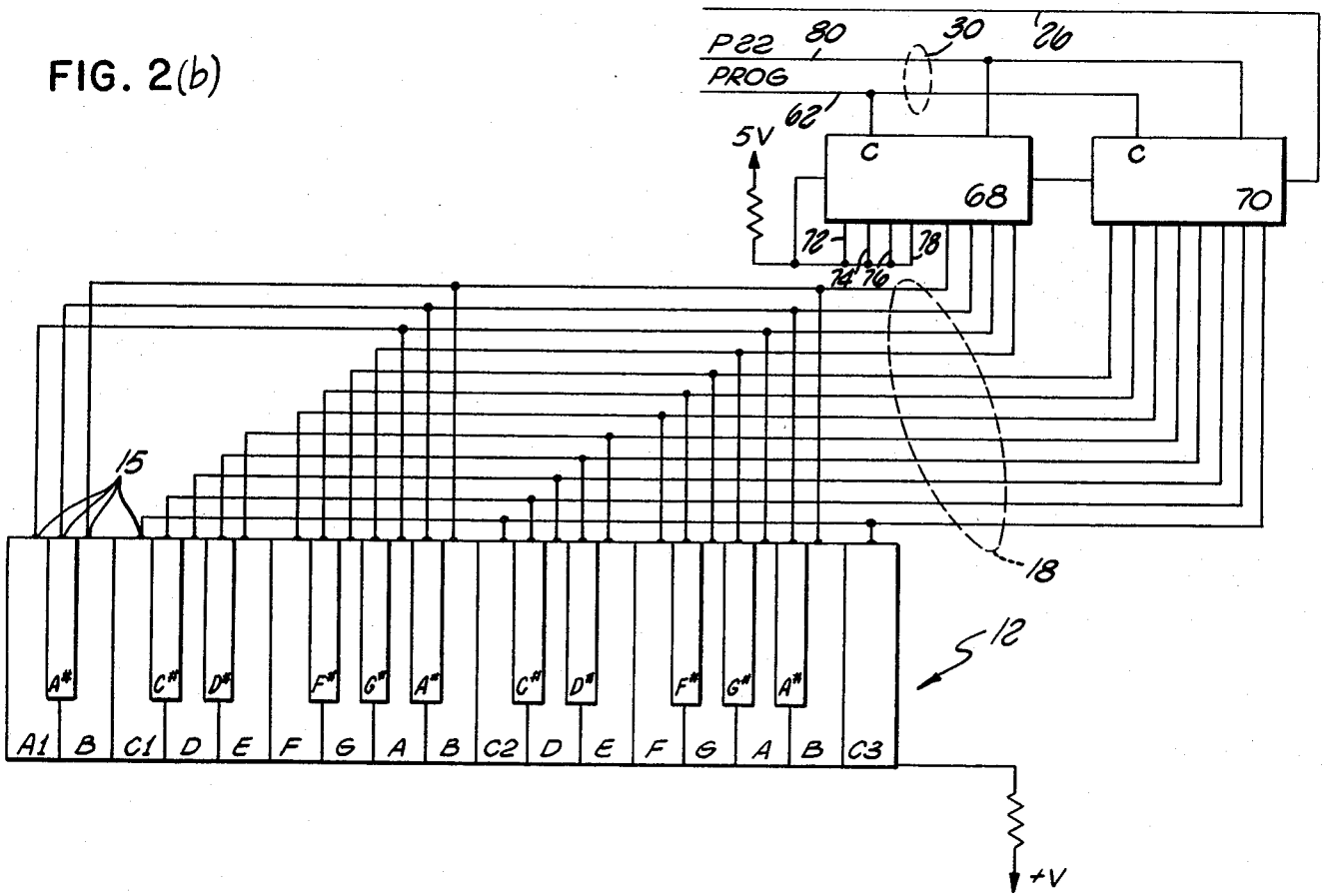

Referring now to the drawings, FIG. 1 is a diagram of an electronic organ system incorporating the present invention. In it, an upper ("melody") keyboard 10 and a lower ("harmony") keyboard 12 provide conventional means for playing the instrument (i.e., for manipulation according to the techniques of musicianship) and for the application of data to the system. The data is processed according to the methods disclosed herein. Such methods rely in part upon the teachings of U.S. patent application Ser. No. 274,606 of the inventors wherein the musical principle of transposition is utilized to derive and sound appropriate accompaniment notes from a preselected set of accompaniment note tables.

Keys 14 are arranged to correspond to standard musical scales and are assigned ordinal numbers for data-processing purposes. Separate melody and harmony keyboards are provided according to FIG. 1. The present invention may also be practiced by means of an organ system utilizing a single keyboard. It will also be noted that the selection of harmony may be achieved by means of a conventional button-type chord selector. In the event such chord selection apparatus is employed, it will be appreciated that the chord detection apparatus and method disclosed infra may be bypassed in implementing the system herein.

A switch is associated with and activated by the application of pressure to a number of the keys 14. Each such switch assumes a first state and, upon the performer striking an associated keyboard key 14, a second, opposite state. In the embodiment of FIG. 1, wherein "low true" input logic is employed, the closing of such a switch by striking its associated key 14 causes the application of a positive voltage +V through a pull-up resistor to a preselected storage location in a shift register (as discussed in connection with FIGS. *2a* and *2b*) to cause the storage therein of a logic "zero".

The data generated by the manipulation of the keyboards 10, 12 is applied in parallel fashion over a melody bus 16 to the upper or melody keyboard register 20 and over a harmony bus 18 to the lower or harmony keyboard register 22. As will be discussed, the registers 20, 22, which are controlled by signals from a microcomputer 28, include shift registers for the storage of successive musical frames defined by the states of the sets of the switches associated with keys 14 depressed at a given instant of time. The frames of data are read out of the registers by the application of clocking pulses from the microcomputer 28. Each of the registers 20, 22 thereby provides playing data, in registration corresponding to the relative locations of the keyboard notes, to the random access memory (RAM) of the microcomputer 28 by means of serial bit streams transferred along a melody conductor 24 and a harmony conductor 26. A timing crystal 29 aids the various functions of the microcomputer 28.

A preferred embodiment of the present invention utilizes an Intel 8048 microcomputer, a programmable device manufactured by the Intel Corporation of Santa Clara, Calif. A detailed discussion of the system operation of the microcomputer 28 will be undertaken with regard to FIGS. *4a* and *4b*. For the present, it will suffice to say that the microcomputer 28 is specifically adapted in the present invention to control the various functions of the organ system.

Figure 6:
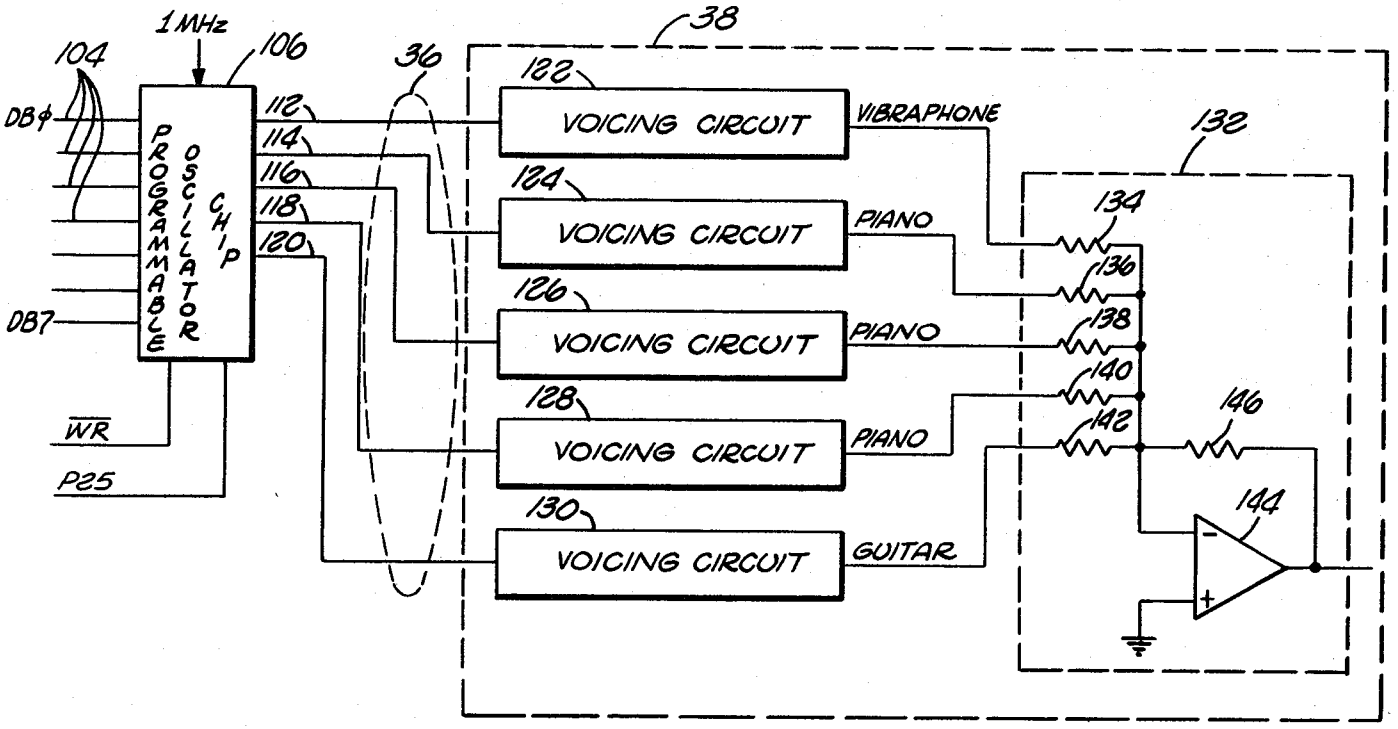
FIG. 6 is a schematic diagram of an alternative embodiment of the output circuitry of the present invention. The circuitry of this figure incorporates an orchestration capability into the system of the present invention.

Data representative of the accompaniment notes generated is provided to output tone switching circuitry 34 by the data bus 32. The output tone switching circuitry 34, which is controlled by the microcomputer 28 includes alternative embodiments illustrated in FIGS. 3 and 6 comprising further novel features of the invention. In the embodiment of FIG. 6, an orchestration capability is achieved. After processing within the output tone switching circuitry 34, resultant analog signals are applied along a bus 36 to voicing and mixing circuitry 38. The circuitry 38 provides an analog waveform for an amplifier 40 which, in turn, feeds the amplified analog signal to a conventional speaker or speaker system 42 to sound the desired music.

FIGS. *2a* and *2b* present in greater detail the input (melody and harmony) systems of the organ. In FIG. *2a*, the upper ("melody") keyboard circuitry, it can be seen that the upper keyboard register 20 includes a plurality of shift registers 46, 48, 50, 52, 54 which communicate with the melody keyboard 10 via the melody bus 16. A plurality of conductors 44 provides electrical connection between a positive voltage, +V, common to each of the keys 14, and an associated location of one of the selected shift registers 46–54 through a corresponding plurality of key-activated switches 15. It will be noticed that the melody keyboard 10 includes only 37 keys. This reflects the fact that, although the standard spinet organ keyboard includes 44 melody keys (F1 through C4), the lower seven keys (i.e., F1 to B1) are not sampled to allow, in the invention, the sounding of a number of accompaniment notes below all melody notes processed. Thus the accompaniment note generation technique of the present invention is not responsive to the potential depression of these lower-scale melody tones. As a reflection of the limited melody input from the keyboard 10 and the utilization of five eight-bit shift registers (each of which may be, for example, a DC 4014B manufactured by the Radio Corporation of America of Princeton, N.J.), the first three locations of the register 46 are tied to a common positive voltage which, for the "low true" input logic employed, corresponds to a logic "zero".

The control bus 30 applies clocking and latching functions to the upper keyboard registers along conductors 62 and 64, respectively. A clock pulse is applied to the registers upon the completion of each melody note computation cycle of the microcomputer 28 (discussed infra). Its application enables the registers 46–54 to retain the data input from the keyboard 10 until forty-four clock pulses have arrived from the microcomputer 28 to read an entire frame of melody data into the microcomputer.

FIG. *2b* is a detailed illustration of the lower ("harmony") keyboard input circuitry. The harmony keyboard 12, the output of which is utilized to identify the chordal-type selected by the musician, also includes a plurality of switches 15, each associated with a single note, for connecting a positive potential +V to preselected locations of shift registers 68, 70 which comprise the lower keyboard register 22. The organ utilizes a harmony keyboard 12 of twenty-eight keys. Unlike the situation discussed with respect to the melody keyboard 10, it can be seen that the twenty-eight outputs of the keyboard 12 are cross-connected in a reducing matrix 66 so that the harmony bus 18 applies only twelve independent, parallel outputs to the registers 68, 70. Corresponding thereto, the first four inputs 72, 74, 76, and 78 of the eight-bit shift register 68 are wired directly to a positive voltage, storing logic "zeros" in the corresponding shift register locations.

Thus, although the harmony keyboard 12 comprises twenty-eight tones arranged in order of ascending frequency, left to right, from the lowest tone (A1) to the highest tone (C3), the reducing matrix 66 assures that the content of the shift registers 68, 70, comprising the lower keyboard register 22, will not reflect the octaval origin of the applied tones. Such simplification of circuitry eliminates harmonically redundant information from the data input of the system. It will be apparent to those skilled in the art that this simplification of data consequently reduces the electronic complexity of the device. The discarding of octave information with respect to the harmony keyboard's input is permitted since chordal identification as to both type and root is independent of octave when determined according to the teachings of the present invention and those of U.S. Pat. No. 4,248,118 of George R. Hall and Robert Hall, for "HARMONY RECOGNITION TECHNIQUES". The teachings and content of this patent, the property of the assignee herein, are hereby incorporated by reference.

As was the case with respect to the upper keyboard register 20, the shift registers 68, 70 of the lower keyboard register 22 receive control signals from the microcomputer 28 by means of the control bus 30. More particularly, the clock line 62 and the latch line 80 control the shift registers 68, 70 in a fashion analogous to the control of the upper keyboard register 20 by the microcomputer 28. The clock line 62 provides identical clocking to the shift registers of the upper and the lower keyboard latches while the melody and harmony shift registers are individually latched by signals carried along the conductors 64 and 80.

Figure 3:
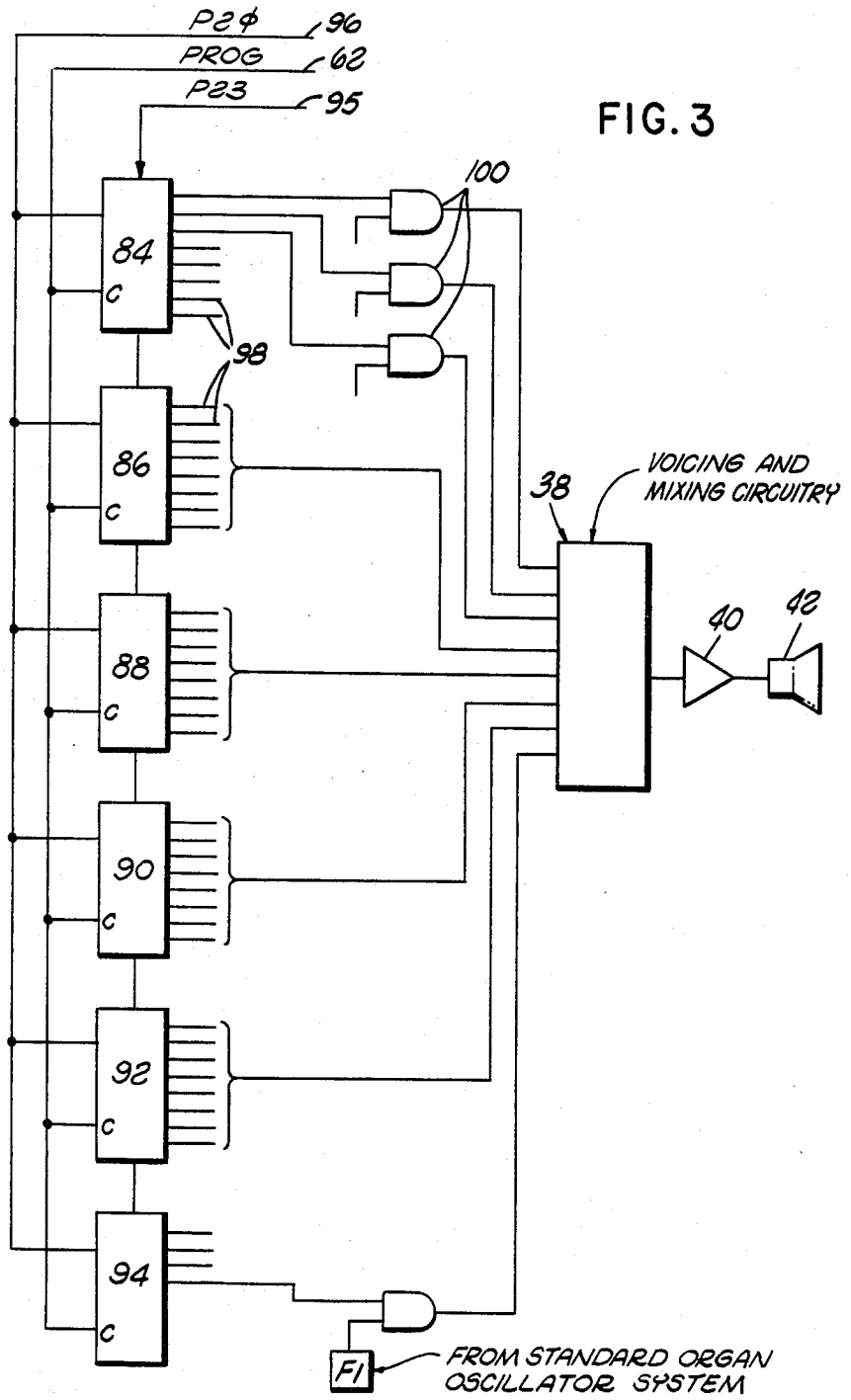
FIG. 3 is a schematic diagram of a first embodiment of the output circuitry including output tone switching apparatus and voicing and mixing circuitry of the present invention.

Referring now to FIG. 3, there is shown a detailed schematic view of output circuitry according to the invention. It includes the interacting output tone switching circuitry 34, voicing and mixing circuitry 38, output amplifier 40 and speaker 42 disclosed in FIG. 1.

The output tone switching circuitry 34 includes six eight-bit serial-to-parallel converters 84, 86, 88, 90, 92, 94, the last four locations of which are unresponsive to incoming data. Each of the converters 84–94 may be a CD 4094 manufactured by the Radio Corporation of America, essentially a combination shift register and buffer-latch. A stream of forty four bits of data, generated by methods to be discussed, is clocked along the conductor 95, which provides electrical connection between the converter 84 and the microcomputer 28, into the forty four utilized locations of the six eight-bit converters. The bits are clocked into the converters 84–94 by the PROG clocking pulses of the microcomputer 28 which are applied along the conductor 62. Each PROG pulse is toggled by the execution of an OUTPUT instruction within the microcomputer 28. Hence, it will be seen, each bit of data generated by the method shown in FIG. 5 is appropriately clocked into the converters 84–94. A latching pulse, provided through the conductor 96, initiates the "dumping" of the data, which has been clocked serially into the converters, along forty four parallel conductors 98. The latching signal is generated upon the affirmative interrogation of a loop counter (the countdown register R4 of the Intel 9048 microcomputer, discussed infra). Affirmative interrogation indicates a system determination that all thirty-seven melody notes of the input have been processed. (Although there appears to exist a discrepancy between the length of the input melody keyboard 10 and the number of tones generated by the output circuitry, one must keep in mind the fact that derived accompaniment notes supplement the tones "called up" by the playing of the input keyboards.)

The forty four parallel outputs applied to the conductors 98 represent forty four independent keying signals. Each keying signal is in turn applied to an AND gate 100, the other input port of which is tied to one of forty four tones generated from a standard organ oscillator system (not shown). The keying pulses applied to the AND gates 100 pass the tones therethrough. Each output of an AND gate, a single frequency analog voltage signal conveying one musical pitch, is applied to the conventional homogeneous voicing and mixing circuitry 38. The circuitry 38 includes standard organ filters and related mixing circuitry, by means of which the individual keyed tones from the AND gates 100 retain tonal integrity as they are combined into a composite signal. The resultant signal is applied to the output amplifier 40 and finally to the speaker 42 which acts as an electro-audio transducer, translating the analog signal into sound.

Figure 4B:
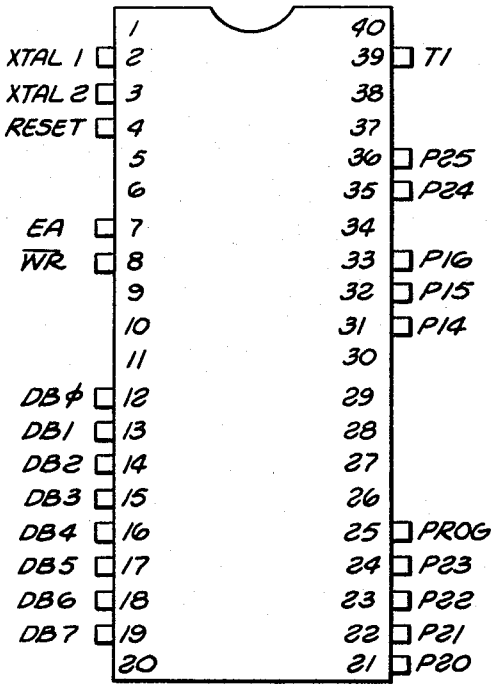
FIGS. 4*a* and 4*b* present a logical schematic and a pin diagram, respectively, of the microcomputer of the present invention, showing the microcomputer functions and pins utilized in the present invention.
Figure 4A:
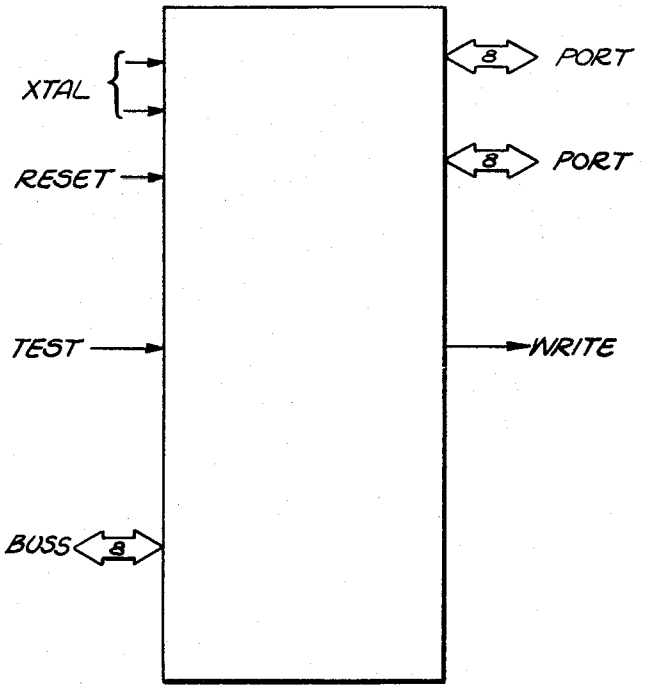

FIGS. 4*a* and 4*b* are detailed illustrations of the microcomputer 28 which supplies the various control functions of the present invention. FIGS. 4*a* and 4*b* use the nomenclature of the Intel 8048 microcomputer chip. In the event a more general appreciation of the details of this machine and its functions may be desired, one can refer to *MCS-48 Microcomputer User's Manual* published by the Intel Corporation of Santa Clara, Calif. (1976). This invention is by no means limited in implementation to this particular microcomputer 28 nor, in fact, to any device, programmable or otherwise, as a control mechanism. Extensive reference to the Intel 8048 is made only for the purpose of illustration and as a basis for reference to the interworkings of the programming schemes illustrated in FIGS. 5*a*, 5*b* and 5*c*.

FIG. 4*a* presents the logical functions of the eight-bit Intel 8048 single component microcomputer which relate to the invention. FIG. 4*b* illustrates the pin configuration of the Intel 8048 employed for the reduction to practice of the invention herein.

Referring concurrently to the above-referenced figures and proceeding down the left-hand side of the logic diagram of FIG. 4*a*, it is seen that the crystal input for the internal oscillator of the microcomputer is connected across the second and third pins of the computer chip. The microcomputer 28 is initialized by the application of a RESET signal generated in an RC circuit which communicates with its fourth pin. The melody conductor 24 transfers the aforementioned stream of melody bits to the thirty-ninth pin, a testable input (T1). The bit state at this pin reflects the state of the rightmost location of the shift register 54 of the melody input latch 20.

The twelfth through nineteenth pins locate an eight-bit data bus which provides a frequency "divisor" to the alternative output configuration illustrated in FIG. 6. This bus is not utilized when the output configuration of FIG. 3 is employed.

Port 1 of the microcomputer 28, a "quasi-bidirectional" port, comprising the thirty-first, thirty-second and thirty-third pins, is unused in the present invention.

Port 2 is a second quasi-bidirectional port. Five of the eight components of port 2, accessed at the twenty-first through twenty-fourth and thirty-fifth pins of the microcomputer 28, are utilized. The pins communicate, respectively, with the output latching conductor 96, the melody input latching conductor 64, the harmony input latching conductor 80, the output conductor 95 and the melody input conductor 24. It may be noted that the port as utilized is clearly bidirectional, in that it both accepts data along the conductor 24 and transfers data out of the microcomputer 28 along the conductor 95.

The eighth and thirty-sixth pins of the chip provide means for communicating addressing signals to a programmable oscillator chip, the data input of which is addressed through the pins of the eight-bit data bus, discussed supra. The data bus forms a significant element of the alternative output configuration of FIG. 6.

Utilizing the apparatus disclosed in the preceding figures, there is employed in the present invention a data processing method including various program steps stored in the internal program ROM of the microcomputer 28. The program steps, by means of which the system processes and operates upon keyboard data to generate various control signals and functions, embody a method for deriving, from the input harmony and melody data, a number of accompaniment notes harmonious therewith and for sounding these notes in accordance with a preselected time dependent sequence so that the resulting sound effects a predetermined musical playing style.

FIGS. 5(*a*), 5(*b*) and 5(*c*) present flow charts of three embodiments of the method of the invention. The disclosed embodiments effect the musical styles known as country piano, strum and accordion (or tremolo), respectively. Each of the methods illustrated includes teachings disclosed in co-pending U.S. patent application No. 247,606 of the inventors herein for "Method and Apparatus for Improved Automatic Harmonization". The methods of FIGS. 5(*a*), 5(*b*) and 5(*c*) share the teachings of the referenced patent application insofar as they employ tables of accompaniment notes wherein appropriate accompaniment notes are arranged and selected according to the harmonic relationship of the melody and the chord selected by the performer. To the extent that the three musical styles employ the teachings of the referenced patent application in like manner, the steps of the methods of FIGS. 5(*a*), 5(*b*) and 5(*c*) are given identical notations. In accordance with that application, proper accompaniment notes are located by a column-addressing technique based upon musical transposition. In the instance of the country piano style as illustrated accompaniment notes are selected from duet-type musical tables while the strum and accordion styles, as discussed below, employ block-type harmonization utilizing tables of columns of four accompaniment notes each. In a duet type table, a single accompaniment note is associated with the melody and, hence, each column of such accompaniment note table contains a single value identifying one accompaniment note.

Referring now to FIG. 5(*a*), the computation for effecting the country piano style is initialized when power is applied to the circuit by application of a RESET pulse to the fourth pin of the microcomputer 28 from an RC circuit. At the same time, the value "zero" is entered into a memory location of the microcomputer 28, which location is designated herein, and in the methods disclosed in FIGS. 5(*b*) and 5(*c*), for reference purposes as OLD KEY. In step S-2, the harmony data of the lower keyboard latch 22 is clocked out of the shift registers 68, 70 and applied to the thirty fifth pin of the microcomputer by the conductor 82. The data of this serial bit stream is scanned for chord type and root by a method such as that disclosed in the above-referenced U.S. patent of George R. Hall and Robert Hall. In this method, playing key pattern representations are stored in a digital memory at locations having addresses defining corresponding chord types. A playing key pattern signal identifying the of the keys played by the performer is then generated and used to locate the corresponding stored playing key pattern representation. When a match occurs, the chord type and root are derived by a processor.

After deriving and storing chord information, the microcomputer 28 proceeds to the processing of melody data. In step S-3, the count of an 8-bit, downcounting register R-1 is set to zero while the count of register R-4 of the Intel 8048 is set to 44. R-1 will be utilized in the method as further described to store the location of accompaniment note information while R-4 acts as a loop or melody note counter, the value of which indicates the number of notes of the melody keyboard which remain to be processed for a given execution of the loop.

The loading of data into the upper keyboard registers 46–54 is signalled by the application of a downgoing latch signal from the microcomputer (twenty-second pin) along the conductor 64 of the control bus 30. Upon transmission of such signal, forty four bits of data are loaded in parallel into the upper keyboard latch 20, the locations of individual bits therein corresponding to the relative locations of the notes of the upper keyboard 10.

Entering the computation loops, at step S-5 the state of the bit located in the rightmost portion of the upper keyboard latch is examined. This location, in communication with the thirty ninth pin of the microcomputer through the conductor 24, initially contains information relating to the melody note C, octave 4 (note number 44). As successive clocking (PROG) pulses shift the data of latch 20 rightward, notes to the left of the aforesaid note are sequentially examined.

Assuming the interrogation at step S-5 does not detect the depression of note C, octave 4, the method proceeds to step S-6 where the value zero is entered into the accumulating register RA of the microcomputer 28. The entry of zero into RA signifies a NOT TRUE condition. When it is followed by an OUTPUT command, the terminal interfacing the twenty fourth pin goes low. (The "OUTPUT" command additionally toggles the PROG clock function so that the low state of the twenty fourth pin is then clocked into the leftmost location of the converter 84 along the conductor 95.)

The register R-1 is decremented in step S-7 and, in step S-8, interrogated to determine whether its count has reached zero. The initial decrementing of register R-1 changes its count from zero to two hundred and fifty-six. Later it will be shown that the count of R-1 is altered by means of the subroutine SWAPM contained in lines 60 through 75 of the country piano program listing of Appendix A.

Assuming that no accompaniment bits have yet been entered into R1 by SWAPM and that R1 has not yet been decremented to zero, the method then proceeds to step S-9, an OUTPUT instruction which directs the aforementioned clocking of a low state (i.e., a zero bit) into the converter 84 in response to the zero value entered into the accumulating register RA at step S-6. Loop counting register R4 is then decremented at step S-10 (to the value "43") and interrogated at step S-11. The latter interrogation determines whether or not all forty-four melody notes have yet been examined or processed by the microcomputer 28. In the event that the count of the register R4 has, in fact, reached zero, the hexadecimal 01H is entered into the register RA, effectuating the latching of the data of the converters 84–94 and the subsequent "dumping" of the resulting keying signal into the plurality of AND gates 100.

Assuming that the interrogation at step S-11 is negative, the process returns to step S-5 and the state of the bit of data which was shifted into the rightmost location of the melody shift register 54 by the toggling of a PROG pulse at step S-9 is now examined. Assuming that the adjacent (forty third) key has been depressed by the performer, the method now enters the portion of the loop beginning at step S-12 where the content of register R4 is compared to the value stored at the memory location OLD KEY. As such value was set to zero at step S-1 and has not been altered at this point in the program, while the value currently stored in the downcounting register R4 has been decremented to forty three, the method proceeds to step S-13 where the value stored at memory location OLD KEY is changed (from zero) to that of the downcounting register R4. This assures that, once TIMER, discussed below, has been initialized, it will not be continually "reset" to zero since the loop portion containing steps S-13 and S-14 will be bypassed during future cycles of the loop beginning with step S-2. At step S-14 the RAM of the microcomputer is addressed at the location containing the software counting loop denominated TIMER that is thereby initialized to zero. This portion of the loop (including steps S-12, S-13 and S-14) serves to initialize TIMER. An identical loop is included in the methods of FIGS. 5(*b*) and 5(*c*) as each of the embodiments employs a counting/timing function as an essential element in achieving a predetermined musical style.

At step S-15, the value of TIMER is interrogated and compared with VALUE, a constant stored in program ROM. The determination and inputting of at least one preselected, constant such as VALUE occurs in each of the illustrated implementations of playing style according to the invention. In each style, the particular constant(s) selected function(s) as a note hold down time and delay that effectively "times" the sequence of selected accompaniment notes to effect the desired musical playing style. Accordingly, the appropriate constant(s) is (are) chosen with regard to the musical effect desired. In all three embodiments, the magnitude of VALUE or its equivalent(s) is (are) chosen to approximate the number of times that the entire loop (with the exception of step S-1) is traversed during a preselected time interval that is related to the corresponding playing style. In the instance of the country piano style, VALUE is selected to approximate the appoggiatura hold down time; that is, the period of time such note is sounded. The inventors have determined that a typical piece of country music played at about 120 beats per minute should have an appoggiatura hold time of about 120 milliseconds. Thus, in the event that, for example, 5 milliseconds are required to traverse the loop, VALUE should be set to a loop count of twenty four.

TIMER, having been set to a zero count at S-14, is smaller than the constant VALUE subsequent to the initial detection of a depressed melody note at step S-5. Thus, the program proceeds to step S-16 where, in accordance with the country piano style a pointer is generated to the set of accompaniment note tables designated "APPOGGIATURA NOTE" by means of the SELECT subroutine. This subroutine, which is contained in the program listing of Appendix A at lines 181 through 213, generates a pointer that directs the computer to a set of APPOGGIATURA NOTE tables stored in program ROM. A similar routine is utilized to generate corresponding pointers in the methods associated with FIGS. 5(*b*) and 5(*c*). While listings of computer programs for effecting such alternate methods are not disclosed herein, it will be appreciated by those skilled in the programming art that those methods are readily achieved by straight-forward adaptation of the teachings of the program contained in Appendix A (which may be found in the application file wrapper of this patent) to the methods described in conjunction with FIGS. 5(*b*) and 5(*c*).

APPOGGIATURA NOTE comprises five duet style tables, each of which corresponds to one of the five chord types which may have been detected at step S-2. Each of such tables contains, for selected melody notes, an accompaniment note which is separated by a single scale tone from an accompaniment note, denoted a sustained note, that is harmonious with the melody.

As an aside, the SELECT subroutine may alternately produce a pointer identifying a second set of tables, designated "SUSTAINED NOTE", at step S-21 when TIMER exceeds VALUE. The SUSTAINED NOTE tables parallel the ACCOMPANIMENT NOTE tables: five separate duet type harmonization tables, each of which corresponds to one of the five chord types which may have been identified at step S-2. Portions of the ACCOMPANIMENT NOTE and SUSTAINED NOTE tables may be identical for a given detected chord type. Such a concurrence will be seen to cause the sounding of individual melody notes without an appoggiatura. Where an appoggiatura is effected, the corresponding notes of the two tables differ by one scale tone. This is proper in a musical sense as the repeated sounding of appoggiatura notes with melody could be considered a monotonous and tiresome musical effect not representing good country piano style. Thus, the accompaniment notes from the APPOGGIATURA NOTE and the SUSTAINED NOTE tables, which are paired and will be seen to be sounded sequentially for a given melody and chord, are derived so that, in the event that the appoggiatura affect is not musically proper, no such effect is sounded.

The APPOGGIATURA NOTE and SUSTAINED NOTE tables corresponding to the detection of a major chord, root C, are listed below:

| | | | | | | | | | | | | |
|---|---|---|---|---|---|---|---|---|---|---|---|---|
| APPOGGIATURA NOTE TABLE | | | | | | | | | | | | |
| melody | C | C# | D | D# | E | F | F# | G | G# | A | A# | B |
| accomp. | G | G | G | G | G | C | D# | D | E | D | E | E |
| SUSTAINED NOTE TABLE | | | | | | | | | | | | |
| melody | C | C# | D | D# | E | F | F# | G | G# | A | A# | B |
| accomp. | G | G | A | G | G | D | D# | E | E | E | E | E |

By comparing the values of the accompaniment notes contained in the foregoing tables, it is apparent that, when a major chord is played by the performer, an appoggiatura affect, wherein the two accompaniment notes differ by a single scale tone, is sounded in accordance with the invention only when the performer has selected one of melody notes D, F, G, and A. (The data identifying accompaniment notes is stored in tables of numbers, each of such numbers representing a tone interval, rather than in the above-noted form. This renders the tables readily amenable to transposition in accordance with melody note and chord root as is taught in the referenced pending application of the inventors.) It is understood that other musically useful effects can be created by using accompaniment notes chromatically adjacent to each other or separated by one or more chromatic tones.

Returning to the flow chart of FIG. 5(*a*), TIMER is incremented at step S-17 and, at step S-18, the subroutine GET AOC is executed . This subroutine manipulates data identified by the pointer generated by the SELECT subroutine at either of steps S-16 (as APPOGIATURA NOTE, contained in the program listing of Appendix A (not printed herein, but on file with the U.S. Patent and Trademark Office in the instant application file wrapper) at lines 228 through 291) or S-21 (as SUSTAINED NOTE, contained in lines 181 through 218).

GET AOC retrieves two bytes, each comprised of two 4-bit nibbles of binary data. As the duet-type tables utilized in effecting the country piano style comprise single-valued columns, only the first or right-most nibble actually identifies an accompaniment note. The latter three nibbles are each zero-valued. The bytes are arranged in the columns of an appropriate (APPOGGIATURA NOTE or SUSTAINED NOTE) accompaniment note table arranged according to and containing information as above-described. The bytes are stored in two registers (R5 and R6) of the RAM array of the microcomputer 28. The first nibble of each pair of bytes represents the interval from the last-named note of the table, going down columns, beginning with the leftmost column. That is, if it were to be determined that the last note called out by the table were the note G, octave 3, then the number 5 as the succeeding entry of the table would correspond to the note located five tones to its left or D, octave 3. The subsequent zeros, which occur in the processing of duet-type tables, indicate no finite interval of tones from the first note.

GET AOC initially locates and addresses the column that contains the desired accompaniment note. To do this, the subroutine employs modulo 12 addition of the difference between the melody note whose depression was detected at step S-5 and the number of the chord root (which was determined in step S-2). Once the computation has been performed and the position of the depressed melody note relative to the chord root is determined, it remains only to detemine the proper duet table to enter, a function on or tne chord type that was detected at step S-2.

The method of computation then proceeds to the subroutine SWAPM (step S-19) which transfers the rightmost 4-bit nibble of the combined registers R5, R6 into R1. This nibble, as stated above, contains the only non-zero column value and, in the instance of duet-type harmonization, identifies, in terms of a tone interval, the single appoggiatura or sustained note selected. In addition, the remaining zero-valued bits are shifted four register locations to the right and a new zero value entered into the leftmost position. The program then proceeds to step S-20 and zero is entered into the accummulating register RA (in the event the melody note is to be sounded by the program in addition to the accompaniment note, one would enter the hexadecimal 08H into RA to set up a "true" output ) In step S-a, an OUTPUT command shifts the zero count of the accumulating register RA to the twenty fourth pin of the microcomputer 28 and toggles the PROG function to clock a low bit into the converter 84.

As before, register R4 is decremented to indicate the completed processing of the last melody note. After an interrogation at step S-11 determines whether the information in the converters 84–94 can be "dumped", the routine returns to the interrogation of step S-5. Assuming that the next melody note (i.e., that to the left of the prior tested note) is not depressed, the method then proceeds to step S-6 and a zero count is loaded into RA in preparation for an output instruction. In step S-7, the register R1, which now contains, via SWAPM, a count equal to the rightmost nibble corresponding to the accompaniment note of the chosen column, is decremented by one. At step S-8, the count of R1 is interrogated to determine whether or not R1 has yet been decremented to zero. By induction, and observing the flow chart of FIG. 5(*a*), one can see that, assuming a second, closely spaced melody note does not interrupt the process by diverting the flow at step S-5 into the sequence of steps S-12 through S-20, additional zero or low output bits will be entered or clocked into the converter 84 via the steps S-9 through S-11 until the interrogation at step S-8 yields an affirmative result. It is achieved after low bits, equal in number to the tone interval separating the (first) accompaniment note from the melody note, have been clocked into the converter 84 since the last affirmative interrogation at step S-5.

The program then proceeds to step S-22 where the SWAPM routine is again called forth. As before, the rightmost 4-bit nibble is shifted by this subroutine into register R1 and the remaining two nibbles of the combined registers R5, R6 are transferred one b 4-bit nibble to the right. As mentioned above, in the duet type tables employed for generation of the country piano style, all of the nibbles other than the rightmost nibble of the two bytes initially retrieved via the GET AOC subroutine are zero-valued.

In step S-23, the hexadecimal 08H is entered into the accummulating register RA. This value causes the system to output a high or "one" bit when the "OUTPUT" command is next given. The "OUTPUT" command and the accompanying toggling of the PROG function occur at S-9. The command enters a high bit into the converter 84 after the serial entry of zero bits equal in number to the value of the rightmost nibble initially retrieved by GET AOC.

The value zero having been entered into R1 via SWAPM at step S-22 AND "decremented" to a value of 256 at S-7, one can see that, assuming no interruptions are caused by the detection of an additional melody note at step S-5, the process will continue to return from step S-11 to the sequence of steps S-6 through S-8 until such time as the interrogation at step S-11 yields a positive result, indicating that all forty four melody notes have been examined. With each traverse of the loop as above described, the "not true" condition is signalled to the output by the entry of the value zero into RA at step S-6 combined with the bypassing of step S-23. As a consequence, zero or low bits comprise the remainder of the stream entered into the converters 84–94.

The process of clocking bits into the converters continues until such time as the interrogation at step S-11 turns positive. When this occurs, the hexadecimal value 01H is entered into the register RA, latching the data within the converters 84–94 and causing it to be "dumped", as latched, into the AND gates 100 so that appropriate tones are gated into the voicing and mixing circuitry 38.

The positions of the bits within the converters 84–94, when latched (i.e. when the interrogation at step S-11 yields a positive result), bear a one-one correspondence to the positions of the keys of the upper keyboard. This results from the fact that the method as above described utilizes the serial entry of data, corresponding to the serial arrangement of tones of the upper keyboard, into the converters 84–94.

With the latching and dumping of data that occurs upon affirmative interrogation at step S-11, the method returns to step S-2. Assuming that the performer has continued to depress the keys of the upper and lower keyboards for a finite amount of time which exceeds the time required for execution of the loop, the chord identificiation of S-2 again recognizes the same depressed chord, by type and root, as before. The program then proceeds to step S-3 where zero is entered into the register R1 and the downcounting register R4, which acts as a loop counter, is initialized to forty-four.

As before, the loading of data into the upper keyboard registers 46–54 is signalled at step S-4 by the application of a downgoing latch signal from the microcomputer. This signal enables the loading of data indicative of the depression(s) of the key(s) of the upper or melody keyboard by the performer into the upper keyboard latch 20. Assuming that the performer has not, in the short period of time required to execute the loop, lifted his finger to change the state of the upper keyboard data, the method will proceed through steps S-6 through S-8 as before, outputting a low bit to the converters 84–94 and returning to step S-5 to examine the adjacent melody note location. As it has been assumed that the performer maintains the depression of selected keys, an affirmative interrogation will occur at step S-5 and the method will enter the portion of the loop beginning with step S-12. This portion of the loop will be executed as before. However, the value of the software loop counter TIMER, which was incremented at step S-17 of the previous cycle, is now equal to "one". Thus, the constant VALUE is compared to one at step S-15 of the present cycle rather than zero.

The identical melody and harmony data having been entered into the microcomputer 28 as before, the method as disclosed will proceed as above. As "one" is presumably less than VALUE, the SELECT subroutine again generates a pointer to the APPOGGIATURA NOTE tables at step S-16 and TIMER is incremented to the value "two" at step S-17. The same keys of the upper and lower keyboard being depressed as before, the identical appoggiatura accompaniment note is retrieved from the appropriate APPOGGIATURA NOTE table by GET AOC as before.

The loop will continue to output data serially as before into the converters 84–94 until such time as the interrogation at step S-11 becomes affirmative and the hexadecimal 01H is entered into register RA, latching the converters 84–94 in the same state as before and outputting identical keying data from the converters 84–94 to the voicing and mixing circuitry 38 through the AND gates 100. Thus the same approggiatura note will be sounded as before. The listener will hear this simply as a continuation of the note formerly sounded.

Upon latching of the output, the loop returns to step S-2 and the method is recycled through the same sequence as before as the performer maintains the some depressions of the upper and lower keyboards. TIMER will continue to be incremented at step S-17 with each cycle of the loop wherein forty-four melody notes are examined. Until such time as the count of TIMER exceeds the constant VALUE so that the program is directed to step S-21 and a pointer generated to the set of SUSTAINED NOTE tables, the data entered into the converters 84–94 will continue to correspond to the identical accompaniment note as before, derived from the appropriate APPOGGIATURA NOTE table, and the selected appoggiatura note will continue to be sounded.

After the loop has been traversed a sufficient number of times so that the interrogation at step S-15 becomes affirmative, a pointer is generated by the SELECT subroutine directing the retrieval of accompaniment note data from an appropriate SUSTAINED NOTE table by means of the subroutine GET AOC. Accompaniment note data from the SUSTAINED NOTE tables is then entered into the converters 84–94 in a serial bit stream generated by a process identical to that described above for selecting and sounding an accompaniment note taken from the APPOGGIATURE NOTE tables. After each cycle of the loop beginning with step S-2, during which all forty-four keys of the upper keyboard are sequentially examined, the hexadecimal 01H is entered into the register RA, latching the data within the converters 84–94 and causing the note selected from the SUSTAINED NOTE tables to be sounded.

The process will continue to return to step S-2 and, as long as the performer continues to depress the same keys of the upper and lower keyboards, the same accompaniment note from the SUSTAINED NOTE tables will continue to be sounded. With each execution of the loop, the same accompaniment note from the SUSTAINED NOTE tables is serially entered into the converters 84–94, latched by the entry of the hexidecimal 01H into the register RA upon an affirmative interrogation at step S-11, and sounded by means of the voicing and mixing circuitry 38. TIMER is not incremented as it was formerly to avoid its undesired resetting as a result of the necessarily finite capacity of any digital or software counter. The aforesaid process resulting in the sounding of the accompaniment note from the SUSTAINED NOTE table ceases when the performer releases the selected melody note.

FIG. 5(*b*) is a flow chart disclosing an alternative embodiment of the method of the present invention whereby the music sounded emulates the non-simultaneous striking of a plurality of notes which occurs, for example, in the strumming of a guitar. While strumming is often associated with the guitar, the sequential sounding (and holding) of haromonically-related tones creates an appealing and realistic musical effect which is not dependent upon a particular instrumentation. Such effect adds a subtle dimension not found in prior art instruments which key simultaneously.

The method disclosed in FIG. 5(*b*) includes a number of the same steps employed in the method disclosed with respect to country piano and such steps are given identical notations in FIGS. 5(*a*) and 5(*b*) to simplify overall explanation. As before, identical processes are undertaken in steps S-1 through S-4 effecting the initializing of ports, the determination of chore type and root, the initializing of the registers R1 and R4 and the latching of the upper keyboard data. Once again, the rightmost melody key location is first examined at step S-5 and, assuming that this key is not depressed, the program enters the portion of the loop, beginning with step S-6, which effects the entry of a zero or low bit into the converter 84. The method again returns from step S-11 to the melody note interrogation at step S-5. Assuming, as before, that the melody note next examined is found to be depressed, the method proceeds to step S-24 where the detected melody note is compared with the value of memory location OLD KEY. This comparison yields a negative response as before. At step S-25, the value stored in R4 is entered into OLD KEY. At step S-26, software counting loop TIMER is initialized to zero.

The value of TIMER is compared successively to the four constants VAL4, VAL3, VAL2 and VAL1, each of which is stored in the ROM of the microcomputer 28. These constants are similar in character to the constant VALUE of the country piano method of FIG. 5(*a*). The constants represent musically related note hold times for sequencing purposes which produce a desired musical (strumming) effect. Unlike the appoggiatura note hold time associated with the constant VALUE in the country piano method, the note hold times relating to VAL1, VAL2, VAL3 and VAL4 refer only to the portion of corresponding note hold time which occurs before an additional note is struck. As discussed in regard to the constant VALUE, each of the four constants represents the number of times the method disclosed in FIG. 5(*b*) (excluding the step S-1) is executed during a musically derived time period.

As TIMER has been initialized to zero, the sequential comparisons of TIMER to the loop counts corresponding to the preselected strum time constants at steps S-27, S-29, S-31 and S-33 will result in negative interrogations the first few times the loop is cycled after a depressed melody note is first detected. Each of such times, the method will proceed to step S-35, incrementing TIMER. When the method proceeds to the GET AOC subroutine at step S-18, however, the subroutine will retrieve two bytes, each comprised of two four-bit nibbles of zero valued binary data. This occurs as a result of the fact that, during the initial negative interrogations, a pointer is not generated to designate any of the tables comprising finite tone intervals from which notes may be derived.

The two bytes of zero-valued information retrieved by GET AOC are stored in the eight-bit registers R5 and R6. The method then proceeds to SWAPM as before where the rightmost four-bit nibble of the register combination is transferred to R1, the remaining bits within registers R5 and R6 are shifted four locations to the right and an additional zero-valued nibble is entered into its leftmost position. A zero is entered into the accumulating register RA at step S-20. An OUTPUT command at step S-9 shifts the count of the register RA to the twenty-fourth pin of the microcomputer 28 and toggles the PROG function to clock a low bit into the converter 84.

R4 is decremented at step S-10 to indicate that a melody note has been examined and the resulting value of R4 is compared to zero at step S-11 to determine whether the data in the converters 84–94 is ready to be latched. Thereafter, the method returns to step S-5 where the data relating to the next melody note is examined. Assuming that the performer has depressed only one melody note, the routine enters the sequence of steps S-6 through S-8. The continual entry of zero values into the register R4, coupled with the "decrementing" of R1 at step S-7 to two hundred fifty six prevents the execution of steps S-22 and S-23 and thus a high or one bit will not be entered into the converters 84–94. Rather, the method cycles through steps S-6 to S-8 and returns to step S-5 through step S-11 until such time as all forty-four notes of the upper keyboard have been examined. Thereafter, forty four low bits will have been clocked into the converters 84–94. This data is latched and then dumped as before, resulting in the production of no sound as no accompaniment note has been designated by the generation of a pointer to a table of finite tone interval values. During this period of time, the only sound heard is that of the melody note played by the performer.

The method returns to step S-2 and repeats the above-referenced sequence as before while the performer continues to depress the same keys of the upper and lower keyboards. Each time the method returns to step S-2, it will, upon detecting the depressed key of the upper keyboard at step S-5, proceed through the sequential interrogations of steps S-27, S-29, S-31 and S-33 and cause a stream of low bits to be entered into converters 84–94 until the cycle has been traversed a sufficient number of times, each time causing the incrementing of TIMER at step S-35, that the interrogation at step S-33 becomes affirmative. When such an event has occurred, a pointer is generated by the SELECT subroutine indicating the group of accompaniment note tables designated "TABLE ONE". (The constant VAL1 has been chosen to have the lowest value of the four constants; hence the tables corresponding thereto, designated TABLE ONE, are indicated first.)

The remaining steps of the program function as before so that, via the subroutines GET AOC and SWAPM, appropriate accompaniment notes are entered into the registers R5 and R6 and transferred sequentially to R1. The accompaniment note tables designated TABLE ONE contain arrays of single-valued columns. For purposes of illustration only, the strum is shown to exist in the context of a block type harmonization wherein the melody note is the initial tone sounded. According to such style, identical notes are sounded one octave apart on either side of the remaining accompaniment notes. Hence the first accompaniment note sounded is the melody note, one octave removed. Thus, each of the accompaniment note tables designated TABLE ONE (there need only be a single table in TABLE ONE) will be:

TABLE ONE

| | | | | | | | | | | | | |
|---|---|---|---|---|---|---|---|---|---|---|---|---|
| Melody Note | C | C# | D | D# | E | F | F# | G | G# | A | A# | B |
| Accomp. Notes | C | C# | D | D# | E | F | F# | G | G# | A | A# | B |

As a single value is to be selected from TABLE ONE by GET AOC and caused to be sounded in accordance with the operations described above, the manipulation of the data following the generation of the pointer to the tables designated TABLE ONE is similar to the output process utilized in conjunction with the country piano style. According to such style, a single appoggiatura accompaniment note and sustained accompaniment note are selected from duet-type tables having single-valued columns.

The note selected from TABLE ONE will continue to be sounded until such time as the method has cycled through the loop beginning with step S-2 a sufficient number of times to increment TIMER (at step S-35) so that the interrogation at step S-31, which precedes step S-33, becomes affirmative. When this occurs, the program is diverted to step S-32, where the SELECT subroutine generates a pointer to the set of accompaniment note tables designated "TABLE TWO". Each of these tables contains columns of two accompaniment notes each. Each column of each of the listings of TABLE TWO adds an additional accompaniment note, selected in accordance with chord type and the block-type harmonization employed for purposes of illustration herein. The accompaniment notes of TABLE TWO corresponding to a major chord, root C, are as follows:

TABLE TWO

| | | | | | | | | | | | | |
|---|---|---|---|---|---|---|---|---|---|---|---|---|
| Melody Note | C | C# | D | D# | E | F | F# | G | G# | A | A# | B |
| Accomp. | E | E | E | F# | G | A | A | A | A# | C | D | C |
| Notes | C | C# | D | D# | E | F | F# | G | G# | A | A# | B |

The above-referenced sequence of tones corresponds to a "downward strum" when played on the guitar due to the guitar's physical structure including a downward sequence of the strings of the instrument from lower pitched to higher pitched strings as the instrument is normally held and strummed. Musically, one will note that, in accordance with the style of strumming selected for illustration, the melody note is first sounded, followed by the melody note one octave lower and a harmonically-related tone located therebetween on the scale chromatic.

The method continues to increment TIMER at step S-35 after the generation of a new pointer to the tables of TABLE TWO and proceeds to step S-6 where GET AOC now enters the column of accompaniment notes from the appropriate one of five tables of TABLE TWO in accordance with the chord type detected at step S-2. As before, the appropriate column is selected and entered into the combined registers R5 and R6 and then input sequentially into R1 by means of the subroutine SWAPM. Each of the columns of the accompaniment note tables of TABLE TWO, having been shown to comprise two tones expressed in finite numerical tone intervals, the two rightmost nibbles of the two bytes entered into the registers R5 and R6 by means of GET AOC are finite values while the two leftmost nibbles are zero-valued.

The two accompaniment notes retrieved by GET AOC are processed according to the method described above and in the co-pending patent application of the inventors to cause the serial entry of a stream of data bits, forty-two of which are low and two of which are high, into the converters 84–94. This stream of data is latched upon a positive interrogation at step S-11 to cause the sounding of the two notes of the selected column of the appropriate accompaniment note table of TABLE TWO in the stead of a single accompaniment note from the corresponding accompaniment note table of the TABLE ONE group. As will be noted, the melody notes from the tables designated TABLE ONE comprise the bottom rows of the TABLE TWO tables. Thus, the accompaniment note formerly sounded will continue to sound as, for example, a string of a guitar continues to vibrate after having been struck.

The above-described process is repeated and the notes from TABLE TWO are sounded until such time as TIMER exceeds VAL 3. When this occurs, the method is directed at step S-29 to step S-30 where a pointer is generated by the SELECT subroutine to the five accompaniment note tables designated TABLE THREE. The accompaniment note tables of TABLE THREE include columns of three notes each, the bottom two notes of which are identical to the notes of the tables of the group of accompaniment note tables denoted TABLE TWO. By like processing to that employed with respect to the output of data from the TABLE ONE and TABLE TWO tables, a column of three accompaniment notes is selected by GET AOC. The notes from such column are sounded in the stead of the two notes selected from the corresponding column and table of TABLE TWO for a period of time during which TIMER is incremented at step S-35 by an amount sufficient to render the interrogation at step S-27 affirmative and a new pointer is generated via the SELECT subroutine at step S-28 indicating the group of five tables denoted TABLE FOUR. The tables denoted TABLE FOUR each comprise columns of four accompaniment notes, the bottom note taken from the corresponding TABLE ONE table, the bottom two notes taken in identical sequence from the corresponding TABLE TWO tables and the bottom three notes taken in sequence from the corresponding TABLE THREE tables. The tables of TABLE FOUR complete the block-type harmonization of accompaniment notes in accordance with the melody and harmony chosen by the performer.

The generation of the pointer to TABLE FOUR at step S-28 results in the retrieval (at step S-6 in accordance with the subroutine GET AOC) of a column of four finite valued tone intervals from one of the five accompaniment note tables of TABLE FOUR. By the processes described above and in the co-pending application of the inventors, a stream of digital data bits, including forty low bits and four high bits, is entered into the converters 84–94 and latched upon the positive interrogation at step S-11 to cause the sounding of the four accompaniment notes selected from TABLE FOUR in place of the three accompaniment notes formerly sounded. The cycle of the method no longer increments TIMER. Thus, the accompaniment notes from TABLE FOUR continue to be output to the converters and sounded until such time as the performer releases the depressed melody note.

Musically, the effect achieved by the sequential sounding of notes taken from the four groups of accompaniment note tables defined as TABLE ONE, TABLE TWO, TABLE THREE and TABLE FOUR is that normally designated as a strum. In the particular embodiment illustrated, the sequence of notes sounded is initiated by the melody note, followed by the melody note one octave removed and harmonious accompaniment notes therebetween in the type of harmonization known as block style. The melody note is sounded before any of the accompaniment notes and remains sounded as it is assumed throughout the foregoing explanation that the melody note remains depressed. Thereafter, accompaniment notes are sounded in groups of increasing numbers of tones, with the formerly sounded tones and groups of tones resounded with each timed switch to a new set of tables of accompaniment notes. The last group of accompaniment notes, including all accompaniment notes having been sounded, is released when the performer releases the melody note.

FIG. 5(*c*) discloses a third embodiment of the invention. This method effects the playing style known as "accordion" or "tremolo". According to such style, the performer alternates two harmonious accompaniment notes at the same time he holds the melody note and a number of other harmonious accompaniment notes. In the illustrated example, the alternating tremolo tones comprise the two lowest scale accompaniment notes of a block-type harmonization.

As before, the method disclosed in FIG. 5(*c*) utilizes portions of the method of the formerly-referenced co-pending patent application of the present applicants to process and sound selected accompaniment notes from groups of accompaniment note tables, once identified. Insofar as processing steps are employed in the method of FIG. 5(*c*) which are common to the methods disclosed and discussed in connection with FIGS. 5(*a*) and 5(*b*), identical numbers are assigned as above.

As before, at step S-2, a chord type and root are identified with the keys of the lower keyboard that have been depressed by the performer and, at step S-5, the keys of the upper keyboard are successively examined to determine the key of the upper keyboard that has been depressed. Upon the detection of such melody note, the method proceeds to the loop beginning with step S-36 wherein TIMER is initialized to zero. At step S-39, the value of TIMER is compared with the preselected constant VALUE, the setting of which sets the tremolo rate. Preferably, each of the alternated tremolo tones should sound about six times per second. Thus, the constant VALUE, which represents the number of cycles of the loop (beginning with step S-2) which will take place during the sounding of a tremolo, should be selected to correspond to a time value of about one-twelfth of a second.

The initial cycles of the loop, beginning with step S-2, after the detection of a depressed key at step S-5 will pass through step S-39, yielding a negative comparison of TIMER with the preselected constant VALUE. Such initial negative comparisons result from the initializing of TIMER to zero at step S-38. The method therefore initially proceeds to step S-42 where the SELECT subroutine generates a pointer indicating one of the five tables of the group denoted "TABLE 1". At step S-44, following the designation of the TABLE 1 group, TIMER is incremented in value. The method then proceeds to step S-18 where, by means of the subroutine GET AOC, two bytes are entered into the registers R5 and R6 from the appropriate column of the accompaniment note table corresponding to the chord type detected at step S-2. The two bytes, subdivided into four-bit nibbles, contain tone interval information identifying the accompaniment notes of the appropriate column from the table of accompaniment notes selected from the group of tables denoted TABLE 1. At step S-19, the subroutine SWAPM causes the rightmost nibble of such data to be entered into the register R1. By methods described above and in the copending application, the nibbles of accompaniment note data are serially entered into the converters 84–94 in a stream of digital data bits (ones and zeros). The data stream is latched upon an affirmative interrogation of the loop counter R4 at step S-11 and the column of accompaniment notes from the selected table is sounded. This combination of accompaniment notes will continue to be sounded as long as the method traverses the portion of the loop including step S-42 so that accompaniment notes are selected from the appropriate listing (i.e. that corresponding to the chord type detected at step S-2) of the group denoted TABLE 1. With each such execution of the loop, the value of TIMER is incremented at step S-44. After the accompaniment notes selected from the listings of notes of TABLE 1 have been sounded for an amount of time approximating the tremolo tone hold time, the comparison at step S-39 becomes affirmative. At this time, the method becomes redirected to step S-40 where a pointer to the group of accompaniment note tables designated TABLE 2 is generated by the SELECT subroutine.

In generating the tremolo or accordion style in accordance with the invention two groups of accompaniment note tables, denoted TABLE 1 and TABLE 2, provide sets of harmonized notes which are sounded alternately at a tremolo rate determined by the preselected constant VALUE. Listed below is a table of accompaniment notes for block-type harmonization with a major chord, root C:

| | | | | | | | | | | | | |
|---|---|---|---|---|---|---|---|---|---|---|---|---|
| Melody Note | C | C# | D | D# | E | F | F# | G | G# | A | A# | B |

-continued

| | | | | | | | | | | | | |
|---|---|---|---|---|---|---|---|---|---|---|---|---|
| Accomp. Notes | A | A# | B | C | C | D | D# | E | E | G | G | G |
| | G | G | G | A | A | C | C | C | C | E | E | E |
| | E | E | E | F# | G | A | A | A | A# | C | D | C |
| | C | C# | D | D# | E | F | F# | G | G# | A | A# | B |

The corresponding major chord tables of the groups designated TABLE 1 and TABLE 2 are as follow:

TABLE 1

| | | | | | | | | | | | | |
|---|---|---|---|---|---|---|---|---|---|---|---|---|
| Melody Note | C | C# | D | D# | E | F | F# | G | G# | A | A# | B |
| Accomp. Notes | A | A# | B | C | C | D | D# | E | E | G | G | G |
| | G | G | G | A | A | C | C | C | C | E | E | E |
| | C | C# | D | D# | E | F | F# | G | G# | A | A# | B |

TABLE 2

| | | | | | | | | | | | | |
|---|---|---|---|---|---|---|---|---|---|---|---|---|
| Melody Note | C | C# | D | D# | E | F | F# | G | G# | A | A# | 2B |
| Accomp. Notes | A | A# | B | C | C | D | D# | E | E | G | G | G |
| | G | G | G | A | A | C | C | C | C | E | E | E |
| | E | E | E | F# | G | A | A | A | A# | C | D | C |

As can be seen, tremolo note tables based upon a given chord type incorporate complementary portions of a set of harmonized accompaniment notes. Thus the alternating of soundings of notes from a table taken from the group TABLE 1 with those from the corresponding table taken from the group TABLE 2 will effect two distinct sounds: (1) insofar as there exist duplications of notes from table to table (i.e. the top two rows), certain of the accompaniment notes will be continuously resounded to effect a set of continuous tones (along with the melody tone) and (2) the portion bottom (row) which varies in the tables from the groups designated TABLE 1 and TABLE 2 will be alternated, during the sounding of the melody, at a rate in accordance with the constant VALUE, to achieve the tremolo effect. Although, as illustrated, the alternating tremolo notes are taken from the low end of the scale of accompaniment notes and block-type harmonization is employed, both of these features constitute mere design alternatives that have been selected for purposes of illustration only. A tremolo effect may be achieved in accordance with the invention by utilizing other types of harmonization or voicing and by alternating notes having different relative scale locations than those shown.

Returning to the flow chart of FIG. 5(*c*), the accompaniment note data from the appropriate column and table of the group designated TABLE 2 will effect the application of a stream of digital data bits to the converters 84–94 in accordance with the process described above. This stream of data will replace the data formerly entered from the tables of the TABLE 1 group as step S-2 is bypassed when the comparison at step S-39 becomes affirmative. The data from the column of the appropriate TABLE 2 listing is latched and sounded upon the positive interrogation of the loop counter R4 at step S-11. The sounding of the accompaniment notes from TABLE 2 continues as long as the performer continues to depress the same keys of the upper and lower keyboards and TIMER, which continues to be incremented at step S-44, does not exceed twice the constant VALUE.

TIMER is incremented to twice the constant VALUE when the accompaniment notes selected from the tables of TABLE 2 have been sounded for approximately the time equivalent of VALUE. This results from the continuous incrementing of TIMER at step S-44 during the soundings of notes from the listings of TABLE 1 and TABLE 2. After the notes from TABLE 2 have sounded for such period of time that TIMER exceeds twice the constant VALUE, the comparison at step S-41 becomes affirmative and, at step S-43, TIMER is reset to zero. Thus, upon the return of the process to step S-39, through steps S-5 et al, the comparison at step S-39 will again become negative resulting in the bypassing of step S-40 and the generation, at step S-42, of a pointer to the listings of the group of tables designated TABLE 1. Assuming that the performer has continued to depress the same keys, the method will cause an identical stream of digital data bits to be input serially into the converters 84–94, latched upon an affirmative interrogation of loop counting register R4 at step S-11 and output, through AND gates 100, to voicing and mixing circuitry 38 to sound the same combination of accompaniment notes formerly sounded from the TABLE 1 group.

TIMER is again incremented through the sounding of the notes from TABLE 1. After it has been incremented by an amount exceeding VALUE, the method is directed by SELECT to the group of listings of accompaniment notes designated TABLE 2 and the notes of this group selected, via GET AOC, are sounded in place of those from TABLE 1. After the column of TABLE 2 notes has sounded for an amount of time corresponding to VALUE, TIMER is reset to zero as before and the process again begins. This process will continue whereby sets of accompaniment notes from corresponding columns of corresponding (by selected chord type) tables from the groups designated TABLE 1 and TABLE 2 are alternately sounded until the performer releases the keys he has depressed. Thus, the music keyed by the performer will be sounded in the musical style known as accordion or tremolo.

FIG. 6 shows an output configuration that may be utilized as an alternative to that of FIG. 3. The arrangement includes an orchestration capability by means of which a number of instrument sounds may play the accompaniment notes derived by the method just illustrated.

Eight parallel conductors 104 comprising the data bus of the microcomputer 28 apply, in two separate loadings, a sixteen-bit divisor to a programmable oscillator chip 106. The chip 106 is a conventional device, the detailed operation of which is disclosed in *Service Manual: Model L-15/L-5*, publication number 993-030885 of Lowrey Organ Division of Norlin Industries, 707 Lake Cook Road, Deerfield, Ill. (September 1979). It is driven by a master oscillator having a frequency of, for example, one MHz for successful functioning within the present system. Internal to the chip are a number (five) of register-comparator-counter combinations. The regiscer addressed retains the sixteen-bit divisor applied from the microcomputer 28 along the conductors 104. The counter keeps count of the number of cycles of the master oscillator, resetting upon a signal from the comparator when the count of the register is equalled. The reset pulses are repeated with a frequency equal to the frequency of the master oscillator divided by the count of the register (i.e., the divisor). Thus, by adjusting the value of the divisor, the frequency of the reset signal applied along one of five conductors 112, 114, 116, 118 and 120 that link the programmable oscillator chip 106 to the voicing circuitry of the output may be set.

Figure 5A:
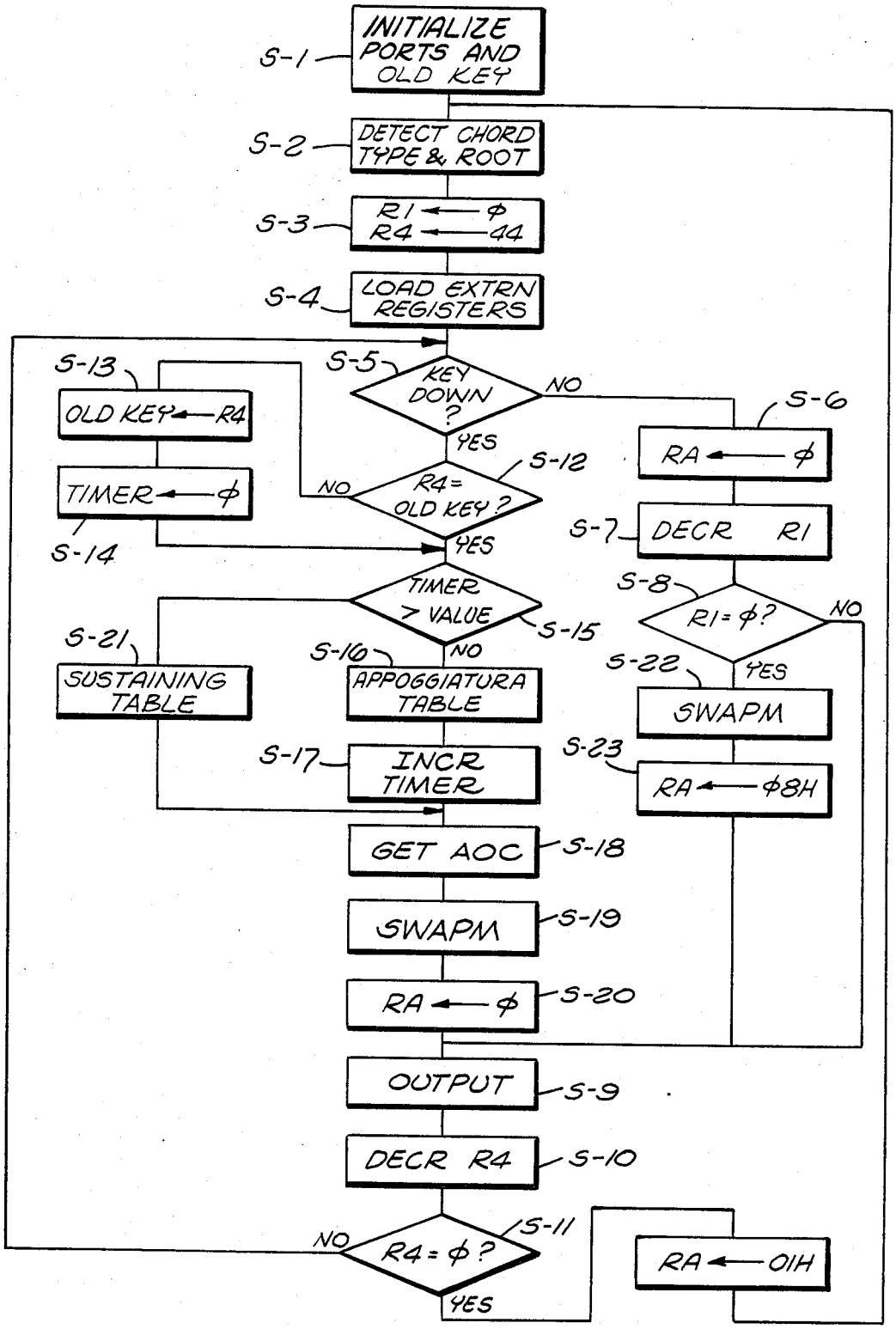
FIGS. 5*a* through 5*c* are flow diagrams illustrating the operations and computations utilized by the present invention in the implementation of the country piano, strum and accordion or tremolo musical styles, respectively.
Figure 5B:
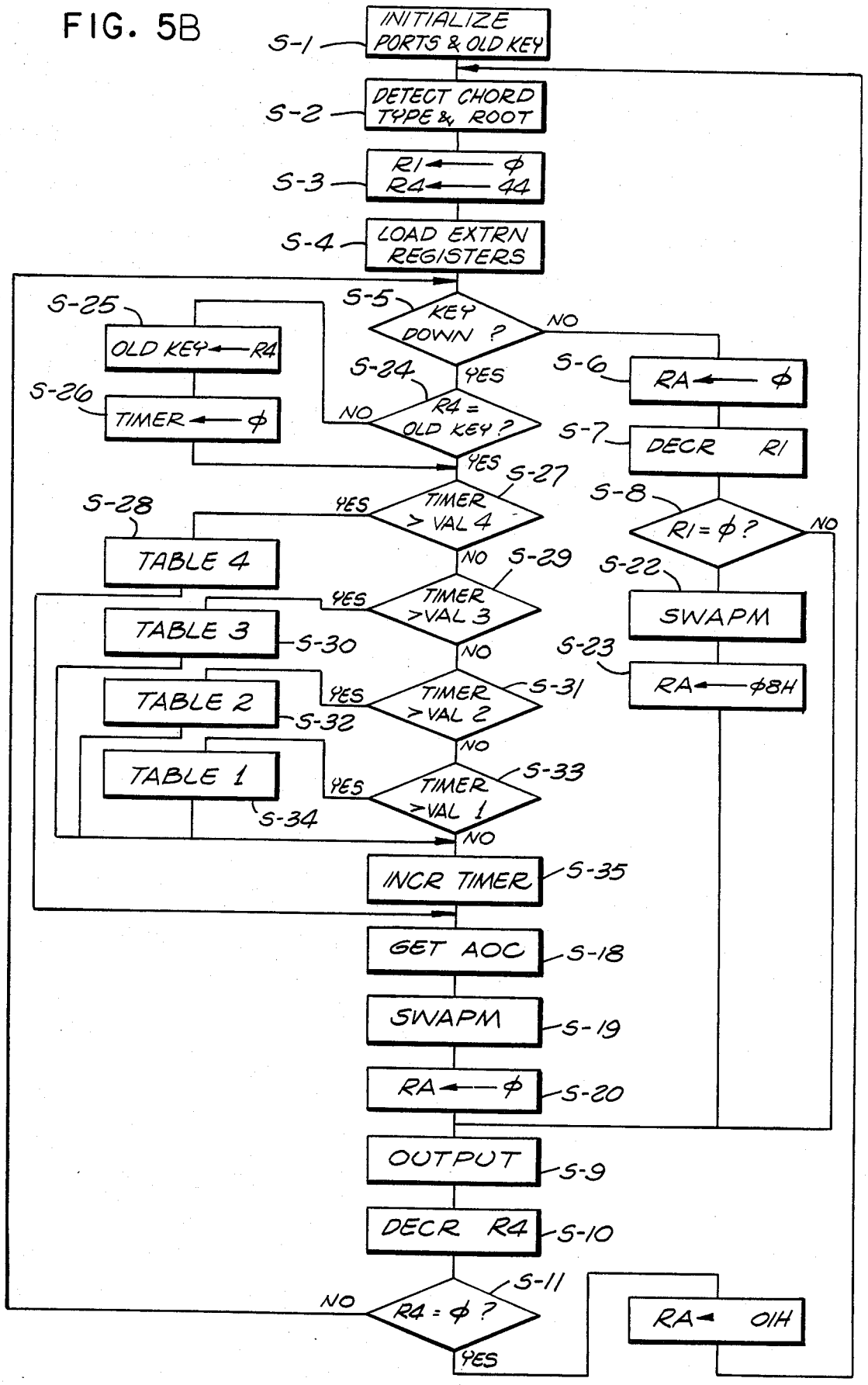
Figure 5C:
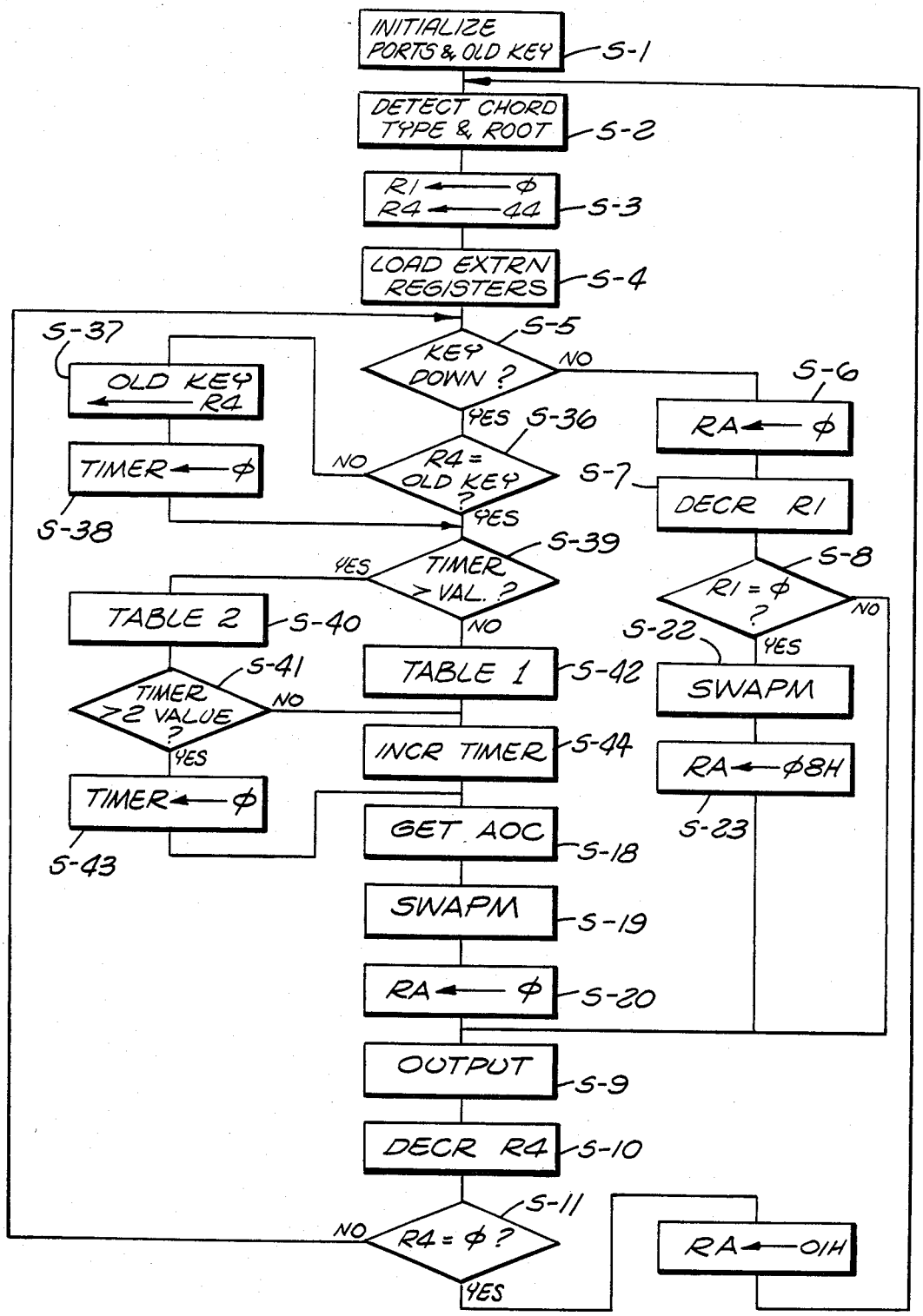

The desired output tones are determined by the decoding of the accompaniment notes generated in FIGS. 5*a*, 5*b* and 5*c*. Once the note to be sounded has been decoded, it is a relatively simple matter to determine the proper divisor to deliver to the twelfth through nineteenth pins of the microcomputer 28. The content of the bus is read into the programmable oscillator chip 106 by the interaction of a WRITE command from the microcomputer 28 to the corresponding input of the chip 106 via the conductor 108 and an ADDRESS/DATA command communicated to the chip 106 from the microcomputer 28 by means of the conductor 110. The loading operation is well known and discernible by those skilled in the art and familiar with the Intel 8048 and related devices. Similar devices may require a different sequence of functional steps to achieve the loading of data. Such sequences will, of course, be dependent upon the particular programmable oscillator chip 106 employed.

Each of the five tones produced by the chip 106 is transferred by one of conductors 112, 114, 116, 118 and 120 to five individual voicing circuits 122, 124, 126, 128 and 130, each of which utilizes filters and envelope circuitry to convert a frequency input into a musical instrument simulation. Thus, an arranger may, by means of the output apparatus of FIG. 6, select an orchestral arrangement (i.e., determine which instruments will play in which octaves and/or be used at all) for playing the melody according to the preselected musical style.

The shaped frequencies emanating from the voicing circuits 122–130 are combined and mixed into a composite analog waveform in mixing circuitry 132 comprising the resistors 134, 136, 138, 140 and 142 in combination with the differential amplifier 144 with associated feedback resistor 146. The output of the operational amplifier is then applied to the output amplifier and speaker or speaker system disclosed in FIG. 1 to produce the orchestrated sound.

Thus it is seen that there has been brought to the musical instrumentation art a new and improved method and apparatus by which music selected by a performer is sounded in accordance with preferred musical styles. A player utilizing methods and apparatus according to the present invention achieves improved harmonization without being limitated to an unrealistic, somewhat mechanical sound occasioned by the simultaneous sounding of accompaniment notes. The methods of the invention, which effect various sequential soundings of accompaniment notes below the melody note, enhance the musician's ability to create stylized performances and greatly enhance the realism of orchestrated performances.

While the invention has been described in connection with its preferred embodiments, it will be understood that it is not limited to the particular embodiments disclosed. Rather, it is intended to encompass all alternatives, modifications and equivalents which fall within the scope of the appended claims.

What is claimed is:

1. A method for deriving, in response to a melody note signal and a chord signal, a plurality of signals representing a corresponding plurality of accompaniment notes harmonically related to said melody note and to said chord and temporally related to effect a predetermined musical style, said method comprising the steps of:

(a) storing a plurality of groups of listings of accompaniment notes, each of said listings of a group corresponding to a chord type and providing at least one accompaniment note harmonically related to each melody note of the chromatic scale with respect to said chord type;

(b) said groups being arranged so that the listings of accompaniment notes for a particular musical chord type are related from group to group in accordance with said predetermined musical style;

(c) providing at least one preselected constant time value; then (d) associating a time value with at least one of said groups of listings;

(e) deriving the root and type of said chord from said chord signal;

(f) deriving said melody note from said melody note signal; then (g) selecting listings from said plurality of groups in accordance with the type of said chord; then (h) locating in each of said listings at least one accompaniment note according to said chord root and melody note; and then (i) sequentially generating a plurality of accompaniment note signals, each of said signals being responsive to said at least one accompaniment note of a selected listing and at least one of said signals having a duration corresponding to the constant time value associated with the group from which it is derived.

2. A method as defined in claim 1 wherein the storing step further comprises the step of entering said sets of listings into the memory of a programmable device.

3. A method as defined in claim 2 wherein the step of sequentially generating a plurality of accompaniment note signals further comprises the steps of:

(a) examining the melody note in a cyclical manner by repeatedly scanning said melody note signal by means of a programmable device; and (b) determining the amount of time utilized by said programmable device to scan said melody note signal; then (c) determining the duration of said at least one accompaniment note by counting the number of times said melody note signal is scanned by means of said programmable device.

4. A method as defined in claim 3 wherein the step of sequentially generating a plurality of accompaniment note signals further comprises the step of generating at least one pointer.

5. A method as defined in claim 4 wherein the counting setp further comprises the step of incrementing a counting loop each time the melody signal is scanned by means of said programmable device.

* * * * *